United States Patent [19]

Pieczykolan

[11] Patent Number: 4,630,682

[45] Date of Patent: Dec. 23, 1986

[54] RAPID RESPONSE SPRINKLER HEAD

[75] Inventor: George S. Pieczykolan, North Wales, Pa.

[73] Assignee: Central Sprinkler Corporation, Lansdale, Pa.

[21] Appl. No.: 703,979

[22] Filed: Feb. 21, 1985

[51] Int. Cl.[4] ..... A62C 37/08

[52] U.S. Cl. ..... 169/38

[58] Field of Search ..... 169/36–42, 169/28

[56] References Cited

U.S. PATENT DOCUMENTS

| | | | |
|---|---|---|---|
| 3,198,258 | 8/1965 | Werner | 169/37 |
| 3,811,511 | 5/1974 | McCulloch | 169/28 |
| 3,834,463 | 9/1974 | Allard et al. | 169/37 X |
| 4,015,665 | 4/1977 | Simons et al. | 169/42 X |
| 4,217,959 | 8/1980 | Poulsen | 169/28 |
| 4,281,718 | 8/1981 | Claussen et al. | 169/41 |
| 4,491,182 | 1/1985 | Pieczykolan | 169/38 |

*Primary Examiner*—Jeffrey V. Nase
*Assistant Examiner*—L. E. Williams
*Attorney, Agent, or Firm*—Seidel, Gonda, Goldhammer & Abbott

[57] ABSTRACT

The latch holding a sprinkler head valve in a closed position is released by a temperature responsive controller. The temperature responsive controller controls actuation of an explosive detonator which in turn fractures a frangible member forming a part of said latch whereby a rapid response is provided.

10 Claims, 5 Drawing Figures

RAPID RESPONSE SPRINKLER HEAD

BACKGROUND OF THE INVENTION

Temperature responsive sprinkler heads are well known. Such sprinker heads suffer from a number of objections. One such objection is the slow response time associated with the melting of a fusable alloy. Another problem associated with prior art sprinkler heads is the "cold sink" affect which slows down the response time of a temperature responsive disk or the like. The present invention is directed to a solution of a problem of providing a more rapid reponse sprinkler head which is extremely sensitive, reliable, and durable.

SUMMARY OF THE INVENTION

The present invention is directed to a rapid response sprinkler head. The sprinker head includes a housing having a flow passage therethrough. A valve member closes the passage. The valve member is supported by the housing and is movable to an open position. The valve member is retained in a closed position by a latch means which includes a frangible member.

An explosive detonator is provided for fracturing the frangible member. Actuation of the detonator is controlled by a temperature responsive control. The detonator fractures the frangible member when the temperature responsive control senses a predetermined temperature. Thereafter, the latch means is released so that the valve member may move to an open position.

It is an object of the present invention to provide a rapid response sprinkler head having extreme sensitivity, while being reliable and durable.

It is another object of the present invention to provide a sprinkler head having a response time which is only a fraction of the time required to melt a fusable alloy pellet typically found in a conventional temperature responsive release mechanism.

It is another object of the present invention to provide a rapid response sprinkler head which can withstand conventional compressive loading forces when installed.

It is another object of this invention to provide a rapid response mechanism for a sprinkler head which is independent of any sprinkler system pressure surges.

It is another object of the present invention to provide a rapid response sprinkler head with the lowest possible compressive forces on a bi-metallic snap disk thereby minimizing frictional forces which would interfere with operation of the snap disk.

It is another object of the present invention to provide a rapid response sprinkler head wherein a temperature responsive controller is thermally isolated from any "cold sink" affect which would slow down the response time.

Other objects will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
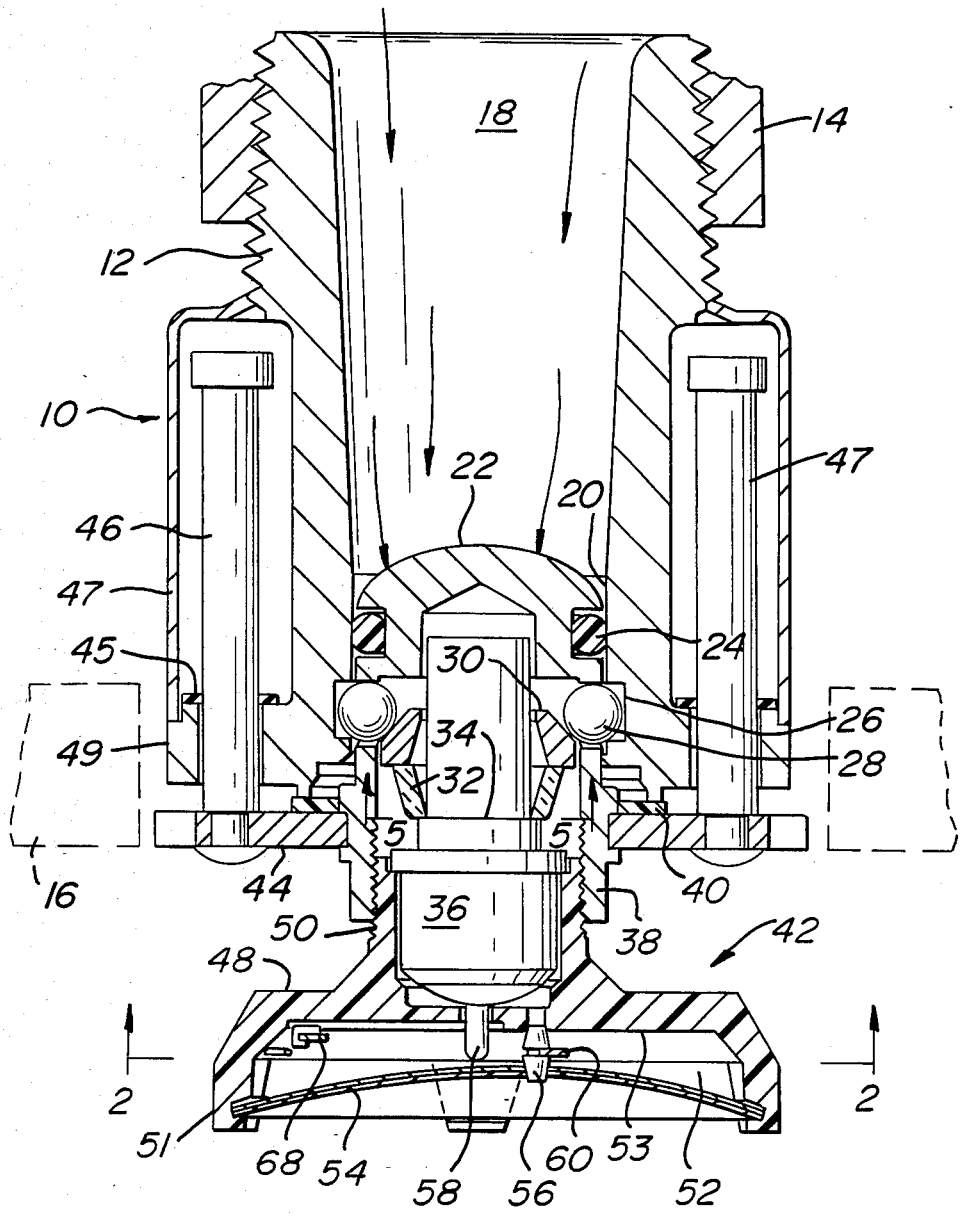
FIG. 1 is a sectional view of a sprinkler head in accordance with the present invention installed in a ceiling.

Referring to the drawings in detail, wherein like numerals indicate like elements, there is shown in FIG. 1 a sprinkler head in accordance with the present invention designated generally as 10. The sprinkler head 10 includes a hollow housing 14 having external threads at its upper end which are meshed with internal threads on a water supply pipe 14. The device 10 is shown in FIG. 1 installed in an opening in a ceiling 16.

The housing 12 has a tapered inlet portion 18 which merges into a straight coaxial portion 20. See FIGS. 1 and 3. The outlet end of the flow passage is closed by a valve member 22. The valve member 22 has a 0-ring seal 24 on its outer periphery in frictional contact with the portion 20. A latch means is provided for latching the valve member 22 in the closed position as shown in FIG. 1.

Figure 5:
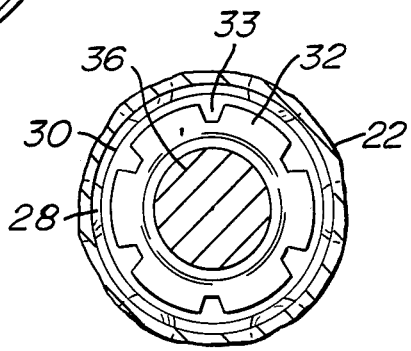
FIG. 5 is a sectional view taken along the line 5—5 in FIG. 1.

The latch means includes a circumferential groove 26 in the straight portion 20 of the flow passage. A plurality of stainless steel balls 28 extend through holes in a hollow portion of the valve member 22 and partially extend into the groove 26. Within the valve member 22, the balls 28 are restrained from moving radially inwardly by a wedgeshaped retaining, ring 30. Ring 30 is supported from below by annular member 32. Member 32 is made from a frangible material such as ceramic, powdered metal, etc. As shown more clearly in FIG. 1, the member 32 is tapered downwardly with its lower end supported by a shoulder 34 on the detonator 36. As shown more clearly in FIG. 5, the member 32 may be provided with a plurality of parallel grooves 33 on its outer peripheral surface so as to provide weakened zones at predetermined locations on the member 32.

The valve member 22 has a cylindrical extension 38 on its lower end. Extension 38 is fixedly secured in any convenient manner to a horizontally disposed deflector plate 44. The interior of valve member 22 is protected from dust and corrosive atmosphere by seal 40 disposed between housing 12 and plate 44. Deflector plate 44 is connected to a plurality of guide pins 46 which extend through holes in a radially outwardly extending flange 49 on the lower end of the housing 12. The pins 46 are enclosed by a shield 47. The pins 46 preferably have a head on their upper end adapted to contact a rubber bumper 45 adjacent flange 49.

A sub-assembly 42 is provided. Sub-assembly 42 includes a housing 48 which is made from a material which is a poor conductor of heat. Housing 48 is preferably made from a thermoset plastic material such as urea-formaldehyde which has a thermal conductivity of 2 to 2.9 Btu/(hr)(ft$^2$) (° F/in). For purposes of comparison, comparable figures for yellow brass is 69, for aluminum bronze is 41, and for stainless steel type 304 is 10. The housing 48 has a cylindrical portion 50. Detonator 36 is supported by a shoulder on the upper end of portion 50. Threads on the outer periphery of portion 50 are meshed with threads on the inner surface of extension 38.

The housing 48 includes a generally horizontal wall 53 integral in one piece with the lower end of the cylindrical portion 50. A rim 51 extends downwardly from the periphery of wall 53 to thereby define therewithin a chamber 52. Chamber 52 is closed by a bi-metallic temperature responsive snap disk 54. The periphery of disk 54 is received within a circumferential groove on the inner periphery of rim 51.

The disk 54 supports a dowel pin 56 having its lower end partially extending through a hole in the disk 54. The upper end of the disk 56 extends into a hole 57 in the wall 53. Hole 57 is shown more clearly in FIG. 3. The detonator 46 has a percussion stem 58 exending through a hole in the wall 53. Percussion stem 58 is coaxial with the rim 51. The interior wall of percussion stem 58 is coated with a friction type spark inducing material adapted to ignite a pyrotechnic powder pellet in detonator 36 adjacent shoulder 34.

Figure 2:
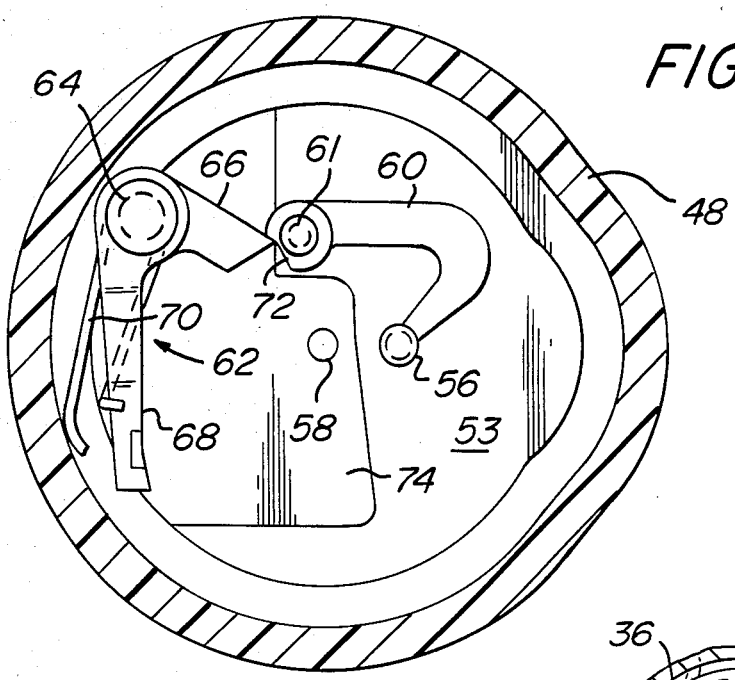
FIG. 2 is a sectional view taken along the line 2—2 in FIG. 1 and showing the components in a latched mode.
Figure 4:
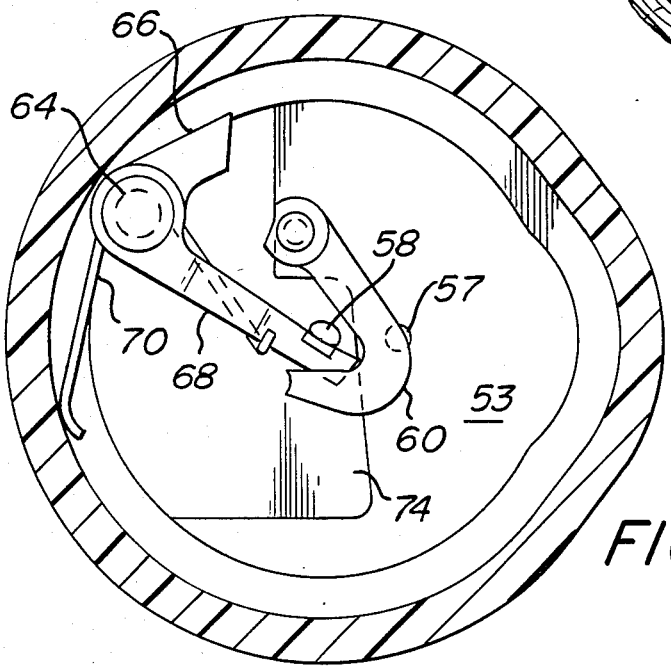
FIG. 4 is a view similar to FIG. 2 but showing the components in an actuated mode.

A temperature responsive controller is provided for controlling actuation of the detonator 36. The temperature responsive controller includes the snap disk 54 and the following elements which are disposed within chamber 52. Referring to FIGS. 2 and 4, the wall 53 supports a latch 60 pivotable about pin 61. The latch 60 is preferably J-shaped with its free end abutting a portion of the periphery of dowel pin 56. Until the snap disk 54 senses a predetermined temperature, dowel pin 56 prevents movement of the latch 60.

Within the chamber 52, there is also provided a lever arm 62. Lever arm 62 is supported by pivot pin 64 on the wall 53. The lever arm 62 includes legs 66 and 68. Lever arm 62 is biased by torsion spring 70 in a counterclockwise direction in FIG. 2. Such movement of the lever arm 62 is prevented by contact between the terminal end of leg 66 and a mating surface 72 on the lever 60. To accommodate the various latch elements, the wall 53 is recessed with such recess being designated 74.

The detonator 36 is an explosive-actuated device which may be referred to as a pyrotechnic device or an electrically actuated frangible link assembly. Commercially available devices of that nature have a response time of ten miliseconds.

Operation of the present invention is as follows. So long as the environmental temperature is below a predetermined temperature such as 135° F., the valve member 22 closes off the outlet from the sprinkler head 12 as shown in FIG. 1. Dowel pin 56 prevents movement of latch 60 as shown in FIG. 2. As a result thereof, the lever arm 62 remains in the position as shown in FIG. 2.

Figure 3:
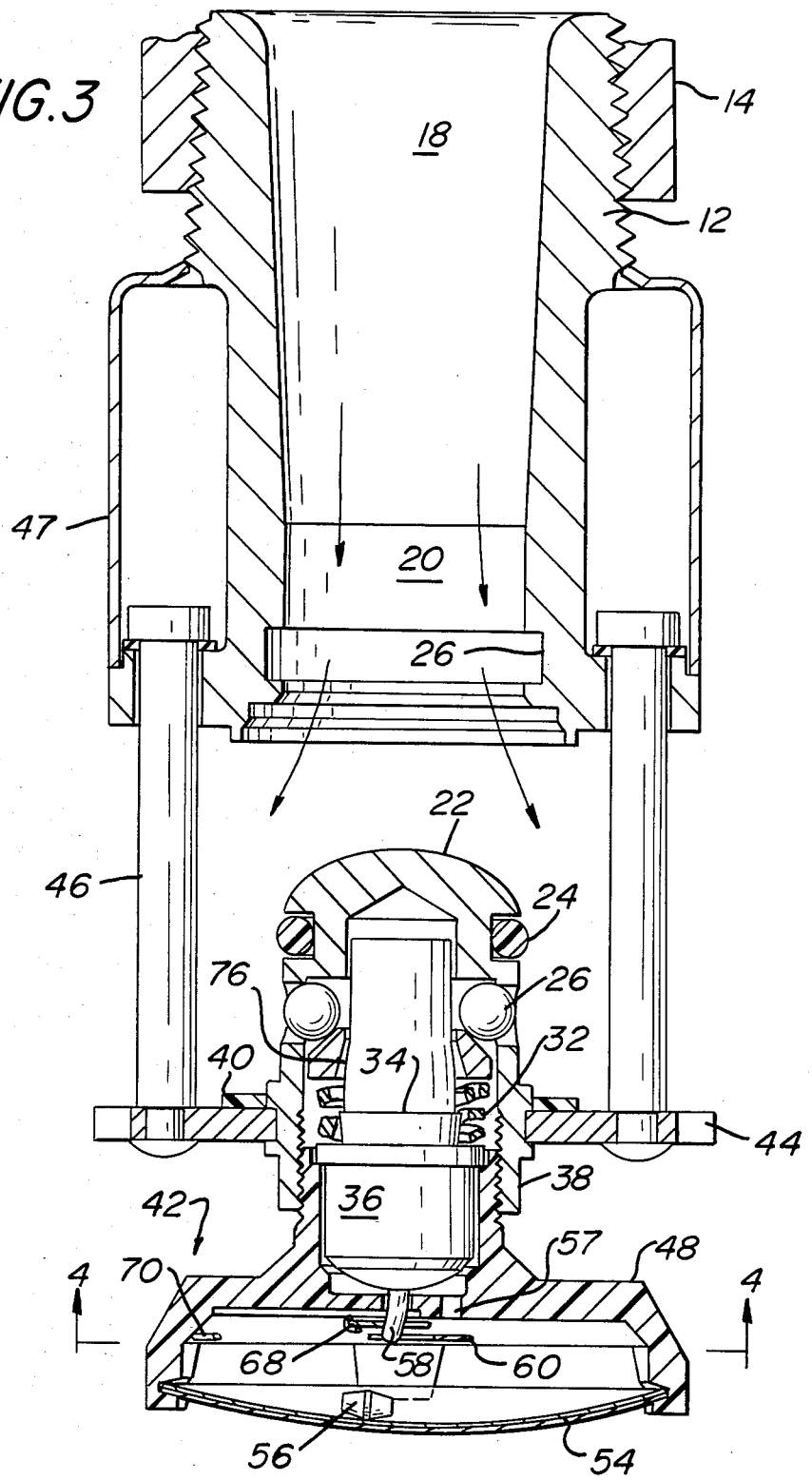
FIG. 3 is a view similar to FIG. 1 but showing the valve member in an open position.

When the bi-metallic snap disk 54 senses the predetermined temperature, it moves from the position shown in FIG. 1 to the position shown in FIG. 3. Such movement releases the dowel pin 56. As a result thereof, spring 70 biases the lever arm 62 to the position as shown in FIG. 4. As the leg 68 pivots counterclockwise from the position shown in FIG. 2 to the position shown in FIG. 4, a hard insert thereof contacts the percussion pin 58 and deforms the same as shown in FIGS. 3 and 4. Deformation of the percussion pin 58 generates a spark within the detonator 36 which ignites the explosive charge within detonator 36.

As a result of the detonation of the explosive charge, the housing of the detonator 36 adjacent the shoulder 34 expands but does not rupture. See the bulge 76 on the detonator 36 in FIG. 3. The increase in the diameter adjacent the bulge 76 is sufficient to fracture the frangible member 32 as shown in FIG. 3. When the member 32 fractures, the wedge shaped ring 30 is no longer supported from below. The fractured pieces of member 32 fall downwardly into the annular chamber surrounding detonator whereby ring 30 can move downwardly for a sufficient distance to allow balls 28 to move radially inwardly. Water pressure from the conical portion 18 acting on the valve member 22 forces the balls 26 radially inwardly and then causes the valve member 22 to move to an open position as shown in FIG. 3. Water discharging from the housing 12 is deflected by plate 44.

With the total elapsed response time from actuation of disk 44 to fracturing of the member 32 being about ten miliseconds, it will be appreciated that the sprinkler head of the present invention has a rapid response time. Since the housing 42 is made from a material having poor thermal conductivity, the bi-metallic snap disk 54 is thermally isolated from the valve member 22 and a housing 12. Hence, the temperature of the housing 12 and valve member 22 will not act to slow down the response time of the snap disk 54.

The mechanism for actuating the detonator 36 is supported by the subassembly 42 so that it is independent of any water hammer or system pressure surges within the supply pipe 14. All compressive forces generated by pressure surges on the upper end of valve member 22 are transmitted via balls 30, ring 30, member 32 and shoulder 34 to portion 50 of housing 48 where such forces terminate. Hence the percussion stem 58 and other components of the response mechanism are unaffected by any such pressure surges.

Friction is minimized between the snap disk 54 and the dowel pin 56 due to the lever ratios shown in FIG. 2 whereby a seven pound spring force on lever arm 62 results in a one pound force between lever 60 and dowel pin 56. In addition to reducing the spring torsion reacting on dowel pin 56, the frictional forces between dowel pin 56 and snap disk 54 are reduced. Since the frictional forces between dowel pin 56 and snap disk 54 are reduced, it is possible to reduce the thickness of snap disk 54 to enhance its sensitivity. When the sprinkler head has been actuated to the position as shown in FIG. 3, it will be noted that all components remain supported by the housing 12 including the dowel pin 56 which remains in chamber 52. The sprinkler head is reusable by merely substituting a new subassembly 42 and new member 32.

The present invention may be embodied in other specific forms without departing from the spirit or essential attributes thereof and, accordingly, reference should be made to the appended claims, rather than to the foregoing specification, as indicating the scope of the invention.

I claim:

1. A rapid response sprinkler head comprising a housing having a flow passage therethrough, a valve member closing said passage, said valve member being supported by said housing and being movable to an open position, latch means including a frangible member for retaining said valve member in a closed position, an explosive detonator for fracturing said frangible member, and a temperature responsive controller for controlling the actuation of said detonator whereby said detonator fractures said frangible member when said controller senses a predetermined temperature to thereby enable said valve member to move to an open position, and said temperature responsive controller and said explosive detonator and deflector plate are supported by said valve member for movement therewith.

2. A rapid response sprinkler head comprising a housing having a flow passage therethrough, a valve member closing said passage, said valve member being supported by said housing and being movable to an open position, latch means including a frangible member for retaining said valve member in a closed position, an explosive detonator for fracturing said frangible member, and a temperature responsive controller for controlling the actuation of said detonator whereby said detonator fractures said frangible member when said controller senses a predetermined temperature to thereby enable said valve member to move to an open position, and wherein said temperature responsive controller is supported by a subassembly whose housing is made from a material which is a poor thermal conductor, said subassembly including a spring biased lever arm arranged to deform a percussion stem on said detonator, a latch on said subassembly restraining said lever arm, and said latch being arranged to release said lever arm when said controller senses the predetermined temperature.

3. A rapid response sprinkler head comprising a housing having a flow passage therethrough, a valve member closing said passage, said valve member being supported by said housing and being movable to an open position, latch means including a frangible member for retaining said valve member in a closed position, an explosive detonator for fracturing said frangible member, and a temperature responsive controller for controlling the actuation of said detonator whereby said detonator fractures said frangible member when said controller senses a predetermined temperature to thereby enable said valve member to move to an open position, and wherein said frangible member comprises an annulus coaxial with and disposed within said valve member, said annulus surrounding a portion of said detonator.

4. A rapid response sprinkler head comprising a housing having a flow passage therethrough, a valve member closing said passage, said valve member being supported by said housing and being movable to an open position, latch means for retaining said valve member in a closed position, an explosive detonator for releasing said latch, a temperature responsive controller for controlling the actuation of said detonator, said temperature responsive controller and said explosive detonator being supported by said valve member for movement therewith, and said temperature responsive controller being supported by a housing made from a material which is a poor thermal conductor.

5. A sprinkler head in accordance with claim 4 wherein said detonator is within a hollow portion of said valve member.

6. A sprinkler head in accordance with claim 5 wherein said controller housing has one end connected to said valve member, the other end of said controller housing having a chamber closed on one side by a temperature responsive disk which is part of said controller.

7. A sprinkler head in accordance with claim 6 wherein said detonator includes a percussion stem extending into said chamber.

8. A sprinkler head in accordance with claim 7 including a spring biased lever arm in said chamber and adapted to deform said stem when said disk senses a predetermined temperature.

9. A rapid response sprinkler head comprising a housing having a flow passage therethrough, a valve member closing said passage, said valve member being supported by said housing and being movable to an open position, latch means for retaining said valve member in a closed position, an explosive detonator for releasing said latch, a temperature responsive controller for controlling the actuation of said detonator, said temperature responsive controller being supported by said valve member for movement therewith, said temperature responsive controller being supported by a housing made from a plastic material which is a poor thermal conductor, said controller housing having one end connected to said valve member, said controller housing having a chamber closed on one side by a temperature responsive disk which is part of said controller, and said detonator having a percussion ignition exposed to said chamber.

10. A sprinkler head in accordance with claim 9 including a spring biased lever arm in said chamber and adapted to deform said percussion ignition when said disk senses a predetermined temperature.

* * * * *